United States Patent [19]

Rochfort

[11] 3,947,167

[45] Mar. 30, 1976

[54] VIBRATING PADDLE ASSEMBLY FOR A SLIP FORMER

[76] Inventor: William P. K. Rochfort, 2800 Seventh Ave. North, Fargo, N. Dak. 58102

[22] Filed: Nov. 5, 1973

[21] Appl. No.: 413,022

[30] Foreign Application Priority Data

Nov. 7, 1972 Canada ..... 155825

[52] U.S. Cl. ..... 425/64; 425/456

[51] Int. Cl.[2] ..... B28B 13/02

[58] Field of Search ..... 425/63–65, 425/456; 259/178 R, 179, 105, DIG. 42; 404/98, 105, 115

[56] References Cited

UNITED STATES PATENTS

| | | | |
|---|---|---|---|
| 2,101,031 | 12/1937 | Little | 259/DIG. 42 |
| 2,750,166 | 6/1956 | Polak | 259/179 |
| 3,123,872 | 3/1964 | Perlmutter et al. | 425/456 |
| 3,430,309 | 3/1969 | Bates | 425/456 |
| 3,751,012 | 8/1973 | Michenko et al. | 259/DIG. 42 |
| 3,792,133 | 2/1974 | Goughnour | 425/64 |

*Primary Examiner*—Francis S. Husar
*Assistant Examiner*—John McQuade
*Attorney, Agent, or Firm*—Charles W. Helzer

[57] ABSTRACT

A concrete slip former having a hopper mounted on ground-supporting wheel assemblies with a front steerable wheel and a pair of tandem individually mounted rear wheel assemblies connected to the hopper through vertical jack adjusting means to control the height and level. The hopper has an open bottom from which an open bottom mold extends rearwardly to shape the concrete mixture as the machine moves forwardly. A paddle assembly is mounted in the hopper for rotation about an axis transverse to the direction of travel of the machine. The paddle assembly is vibrated by mechanical, pneumatic and/or electrical means during rotation of the paddle assembly.

9 Claims, 6 Drawing Figures

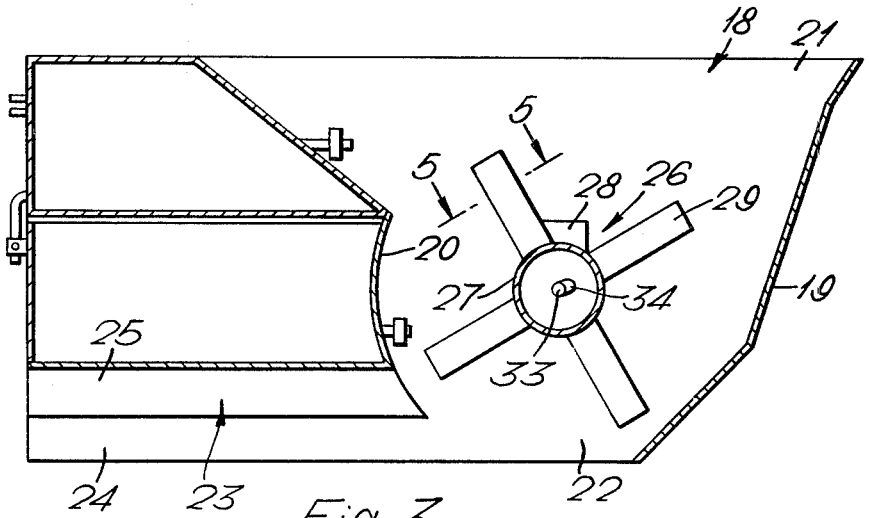
Fig. 3.
Fig. 5.
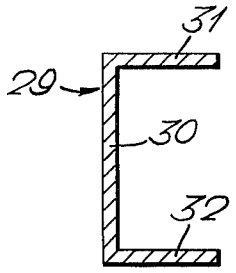

VIBRATING PADDLE ASSEMBLY FOR A SLIP FORMER

This invention relates to improvements in concrete slip formers, and more particularly, to a driven paddle assembly in the hopper for transferring the mixture from the hopper to the mold extending rearwardly from an open bottom in the hopper and including a vibrator to vibrate the paddle assembly and/or arms thereof during rotation and to a paddle assembly including means for vibrating the same.

Concrete slip formers having a paddle assembly therein are known, as exemplified by Australian Pat. No. 292,398 accepted July 9, 1969 in the name of Francis William Quintel. The slip former consists of a hopper having an open bottom with a forming mold extending rearwardly therefrom to shape the deposited concrete as the machine is propelled forwardly. A driven paddle assembly, located in the hopper, agitates the mixture therein and transfers the same into the leading end of the mold compacting the concrete in the mold as the machine moves forwardly. It has been found in practice considerable power is required to drive the paddle assembly and the object of the present invention is to provide modifications in the paddle assembly to reduce the power requirement while, at the same time, retaining the advantages of utilizing a paddle assembly in such type of machine.

In accordance with the present invention, there is provided a paddle assembly for use in a slip former which is vibrated as a whole or in part during rotation, thereby facilitating compacting the concrete mix during depositing of the same in the mold.

There is also provided in accordance with the present invention a concrete slip former having a driven paddle assembly mounted in the hopper thereof to mix and agitate a mixture therein and force the mixture through an outlet from the hopper into an open bottom shaping mold wherein said driven paddle assembly comprises:

a. a longitudinally extending hub;
b. means for mounting said hub in said hopper for rotation about the longitudinal axis of said hub;
c. a plurality of arms secured to said hub and radiating outwardly therefrom; and
d. means for vibrating at least a portion of said paddle assembly during rotation thereof.

During use of the known paddle assemblies, it has been found a mass of concrete mixture accumulates in the centre of the paddle assembly and rotates therewith rather than becoming mixed with the remainder of the concrete mix in the hopper during rotation of the paddle assembly. To overcome this, and in accordance with the present invention, a modified paddle assembly is provided wherein the hub portion is larger than the previously known assemblies and at least some of the arms radiating outwardly therefrom are of channel or scoop shape to move the concrete from adjacent the hub toward the terminal ends of the paddles during rotation of the paddle assembly.

In accordance with a further aspect of the present invention, there is provided a paddle assembly for use in a hopper to mix and agitate a mixture therein and force the mixture through an outlet therefrom, wherein said paddle assembly comprises a longitudinally extending hub having a plurality of arms radiating outwardly therefrom with at least some of said arms comprising scoops which radiate outwardly from the hub for transferring mixture from adjacent the hub toward terminal ends of the arms during rotation of the paddle assembly.

The invention is illustrated by way of example with reference to the accompanying drawings, wherein:

FIG. 3 is a diagrammatic cross-sectional view of the hopper and mold assembly with a vibrating paddle assembly mounted therein in accordance with the present invention;

FIG. 5 is a cross-section taken along Section 5—5 of FIG. 3; and

Figure 1:
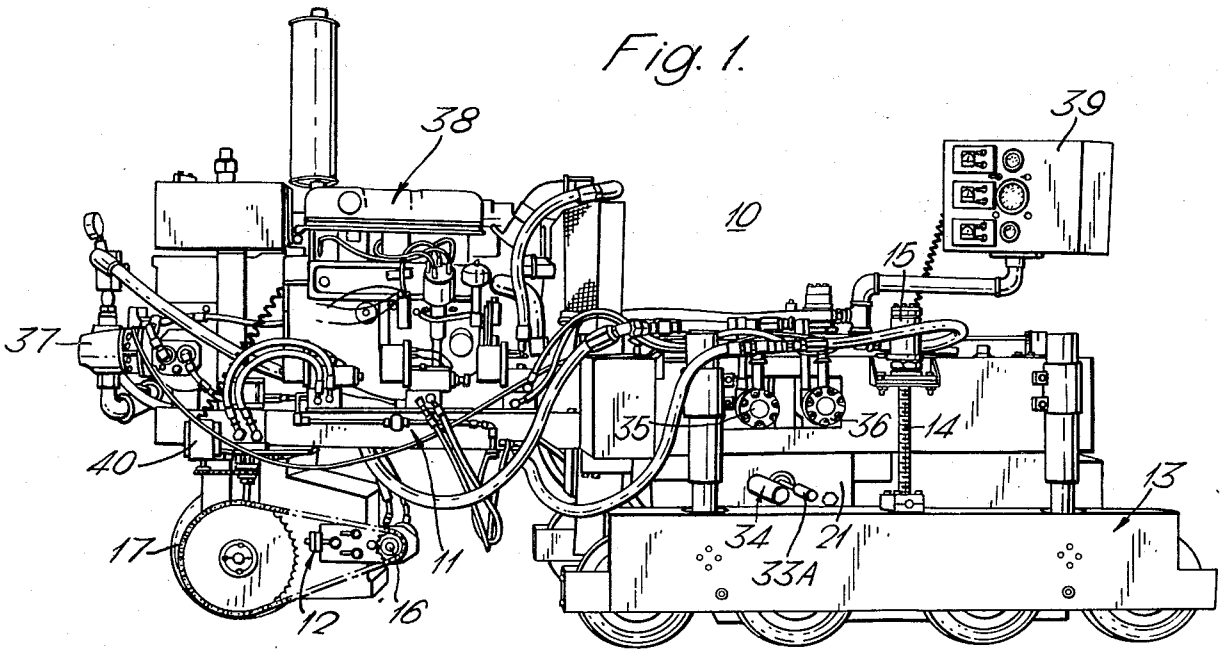
FIG. 1 is a side view of a concrete slip former incorporating a vibrating paddle assembly in accordance with the present invention.
Figure 2:
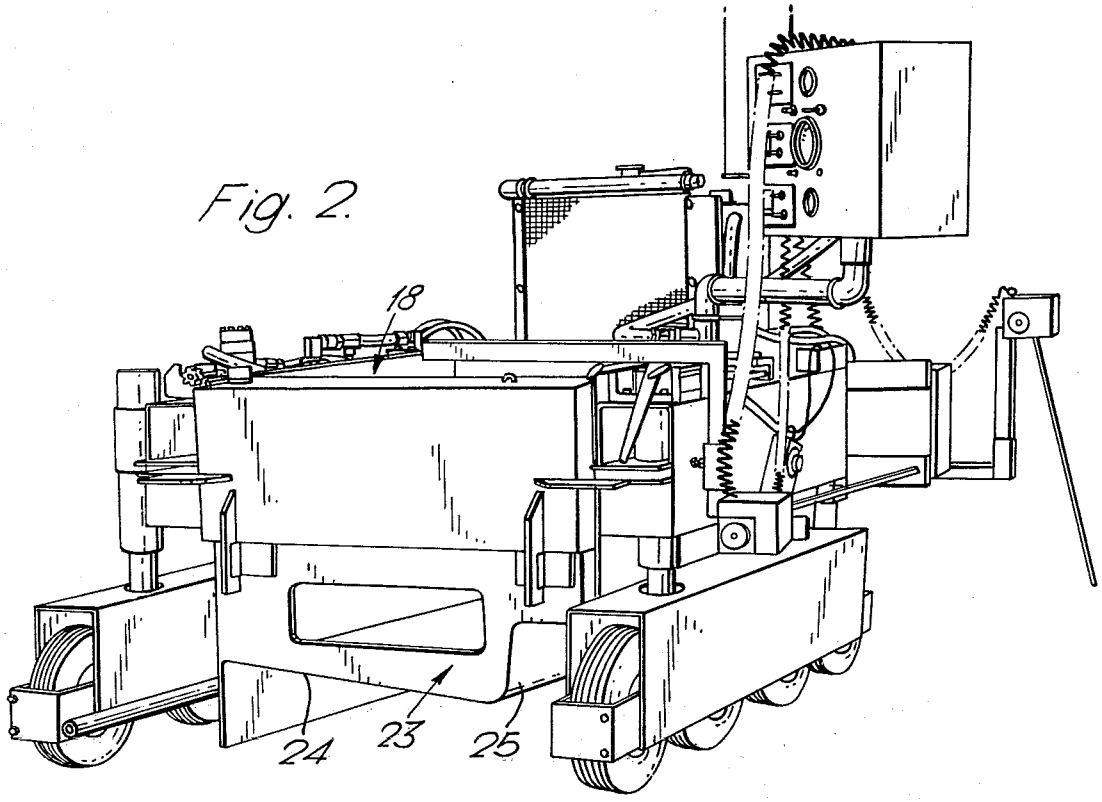
FIG. 2 is an oblique view of the machine shown in FIG. 1 taken from the rear.

Referring now to the drawings, shown in FIGS. 1 and 2 is a concrete slip former 10 having a frame portion 11 supported at the forward end by a front steerable wheel 12 and at the rear by a pair of laterally spaced-apart, independently mounted tandem wheel assemblies 13. The tandem wheel assemblies are connected to the rear frame portion through a vertically disposed screw jack 14 driven by a hydraulic motor 15 for vertical adjustment to maintain a selected height of deposited material as the machine moves forwardly over undulating terrain.

The front wheel assembly 12 is driven by a hydraulic motor 16 through a chain drive assembly 17.

The rear portion of frame 11 supports a hopper assembly 18 having a front wall 19, a rear wall 20, a pair of opposed side walls 21 and an open bottom wall 22. Extending rearwardly from the open bottom wall 22 is a longitudinally extending shaping mold 23 which, in the present instance, has a portion 24 to define a gutter and a portion 25 to define a curb in a ribbon of concrete deposited by the machine as it is propelled forwardly.

A paddle assembly 26 is rotatably mounted in the hopper to mix the concrete mixture therein and force the mixture through the outlet into the open leading end of the mold as the machine moves forwardly.

The paddle assembly 26 consists of a longitudinally extending hub 27 journalled at opposed ends in bearing assemblies 28 on respective ones of the hopper opposed side walls 21. The journals 28 may be adjustably mounted, as for example, by screw jacks in the respective walls permitting variously adjusting the paddle assembly for different vertical heights relative to the open bottom wall of the mold.

The hub 27 of the rotating paddle assembly 26 may be mounted in resilient blocks in the bearing assemblies 28, minimizing the vibration transferred therefrom to the hopper assembly 18.

A plurality of arms 29 are secured to the hub 27 and radiate outwardly therefrom at positions spaced apart circumferentially around the hub and longitudinally therealong. At least some of the arms or all of them are channel-shaped in cross-section (see FIG. 5) consisting of a web 30 having spaced-apart legs 31 and 32 extending outwardly therefrom longitudinally therealong. The legs 31 and 32 extend from the web in a direction leading forwardly of the web in the direction of rotation and provide effectively scoops which radiate outwardly from the hub. During rotation of the paddle assembly, the concrete moves longitudinally along the respective arms toward the outer ends thereof, thereby moving the mixture of concrete from adjacent the hub to the outer periphery of the rotating assembly.

The hub 27 is a tubular member having a shaft 33 extending longitudinally therethrough and journalled for rotation in respective opposed ends of the hub and/or hopper opposed side walls 21. The shaft 33 has one or more eccentric weights 34 thereon to cause vibration of the rotating paddle assembly. The shaft 33 may be driven in any convenient manner, as for example, through a shaft portion 33A extending outwardly through the hopper side wall 21, such extending portion being driven by, for example, a hydraulic motor assembly 34 connected either directly thereto or through a suitable drive train.

The paddle assembly 26 is driven for rotation by a pair of hydraulic motors 35 and 36 through a suitable gear box and drive train.

Hydraulic pressure for the hydraulic motors 15, 16, 34, 35 and 36 is provided by a pump, or series of pumps, 37 driven by an internal combustion engine 38 mounted on the forward end of the frame 11. The hydraulic motors may be individually controlled manually and/or automatically through a control box 39 mounted on the rearward portion of the machine at a position convenient for operation by the operator. A further hydraulic motor 40 is provided for steering the front wheel 12. The height control motors 15 and steering motor 40 may be automatically controlled by sensors engaging a pre-set datum line supported on posts to one side of the machine at the desired reference elevation and path of travel for the machine.

Figure 4:
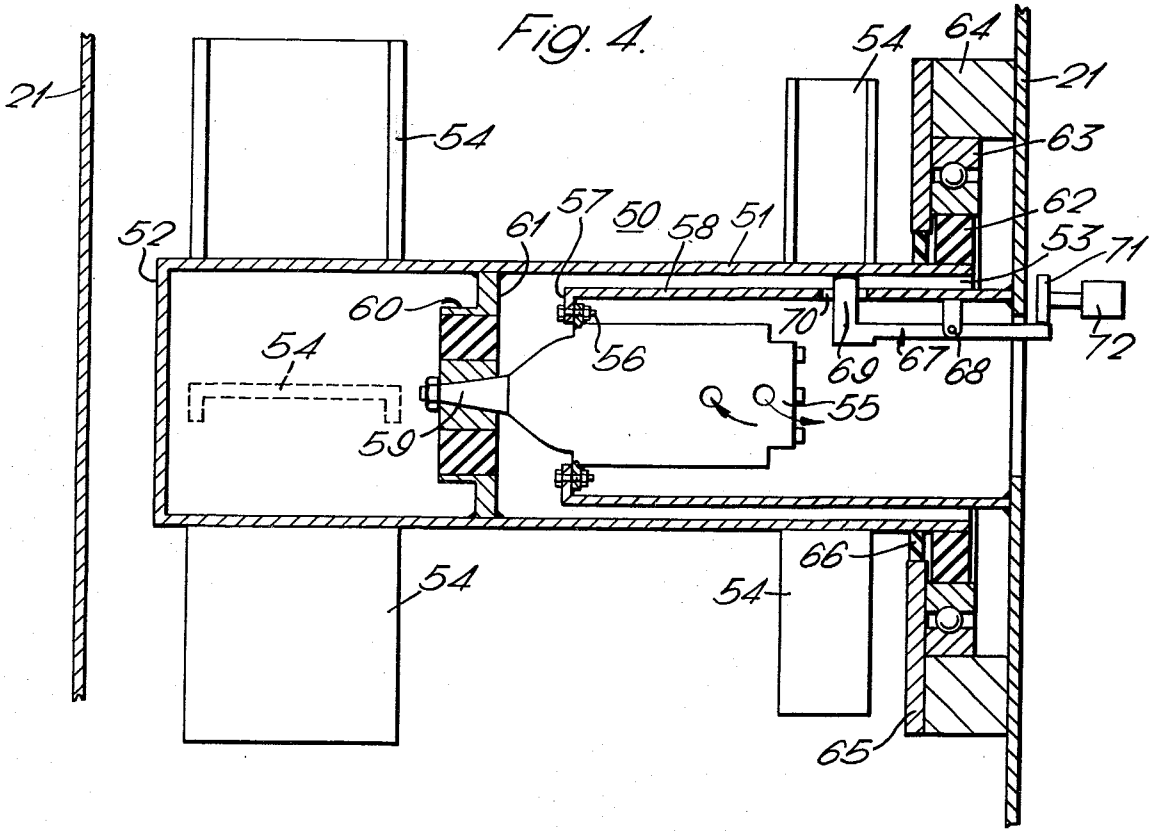
FIG. 4 is a partial, cross-sectional view showing a modified vibrating paddle assembly.

In FIG. 4, there is shown an alternative arrangement for the vibrating paddle assembly cantilevered from one side wall of the hopper. Referring to FIG. 4, there is illustrated a vibrating drum-type paddle assembly 50 cantilevered from the hopper wall 21 and projecting therefrom in a direction toward the opposed hopper side wall 21. The paddle assembly 50 consists of a sleeve or drum-type hub 51 having a closed end 52 and an opposite open end 53. Secured to the hub and projecting radially outwardly therefrom at circumferentially spaced positions longitudinally along the drum are a plurality of paddle blades 54 having the same cross-sectional configuration as shown in FIG. 5. The paddle assembly 50 is driven for rotation by a hydraulic motor 55 secured by bolt and nut assemblies 56 to end flange 57 on a motor mounting sleeve 58. The sleeve 58 is concentric with the sleeve 51 and projects thereinto from side wall 21 to which the sleeve 58 is secured. The motor 55 has a drive shaft 59 secured in driving relation to the sleeve 51 by a shock-absorbing rubber and steel bushing 60. The steel portion 61 of the bushing is secured to the sleeve 51 (intermediate opposed ends thereof) as by welding or the like. The rubber portion of the drive assembly 60 is of a type which will withstand considerable torque and provides a cushion between the motor and the paddle assembly. The hub 51, adjacent open end 53, has an annular rubber or other resilient pad 62 secured thereto and which engages an annular bearing 63. The bearing 63 is held securely to hopper wall 21 by a bearing carrier 64. The hub 51, accordingly, adjacent the open end 53, is journalled for rotation on the hopper wall 21. The bearing 63, resilient mount 62 and bearing carrier 64 are covered by an annular plate 65 sealing the same against concrete mix in the hopper during operation. The annular plate 65 has an annular rubber seal 66 secured thereto which is interposed between the plate 65 and hub 51 for sealing foreign material from entering between the cover plate 65 and the bearing.

The hub 51, with paddle members 54 attached thereto, is vibrated by a hammer 67 pivotally attached to the hub 58 by a pin 68 and having a head 69 engageable with the inner surface of the sleeve drum 51. The hammer head 69 passes through an aperture 70 in a wall of sleeve 58. The hammer 67 is oscillated about pin 68 to alternately strike the hub 51 by a motor driven cam 71 which engages a lever or handle portion of the hammer 67. The cam 71 is driven by a hydraulic or electric motor 72.

In the foregoing embodiments, an eccentric cam within the shaft is illustrated in FIG. 3 for effecting vibration and in FIG. 4; the foregoing described hammer assembly is utilized. As an alternative to these mechanisms for vibrating, electric and/or pneumatic means may be utilized. The electric and/or pneumatic mechanisms may be attached at various positions internally of hub 51 transmitting vibrations thereto through oscillating mechanisms in the hydraulic and/or electromagnetic mechanisms.

Figure 6:
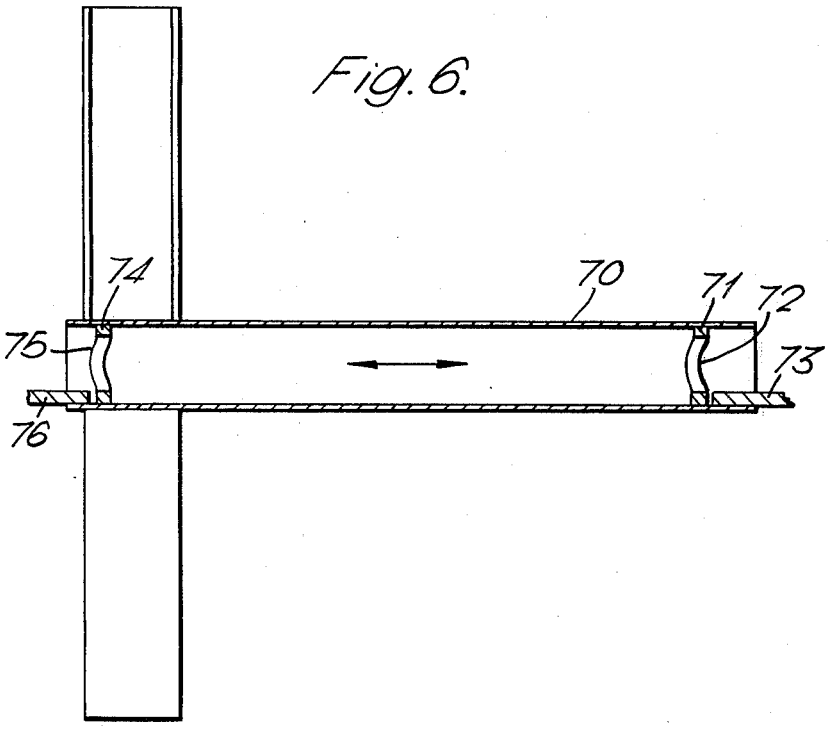
FIG. 6 is a schematic of a modification for mounting the paddle assembly.

In addition to vibrating the paddle wheel assembly, a further alternative is illustrated in FIG. 6 diagrammatically illustrating mounting the hub of the paddle assembly for oscillating movement longitudinally of the shaft. The longitudinal oscillation of the hub may be used in place of vibrating the assembly, or alternatively, in combination therewith.

Referring to FIG. 6, there is diagrammatically illustrated a hub 70 for a paddle assembly of the type shown in FIGS. 3 or 4 wherein there is included on the inner surface of the hub a cam 71 having an undulating cam-follower surface 72 for engaging a cam 73 secured to a side wall of the hopper. A similar arrangement at the opposite end of the hub 70 consisting of a cam follower 74 having a cam face 75 engaging a cam 76 secured to the hopper wall acts in conjunction with the cam and cam follower at the opposite end to effect reciprocal movement of the hub in a direction longitudinally of the hub.

In each of the foregoing embodiments, means may be provided to vary the frequency of vibrations and/or the degree of vibration imparted to the paddle assembly. The frequency of vibration in the embodiment illustrated in FIGS. 3 and 4 may readily be varied by altering the speed of the vibrating member. In FIG. 3, this can be effected by controls on the motor for driving the eccentrially weighted rotary shaft 33 and in FIG. 4, controlling the speed of motor 72. To vary the degree of vibration in the embodiment illustrated in FIG. 3, eccentrics 34 may be mounted on a shaft controllably rotatably about shaft 33 to variously position the eccentrics relative to one another at different peripheral locations around the axis of rotation. Bringing the weights into alignment with one another at one peripheral location will provide maximum impact or degree of vibration while rotating, say, half of the weights to a position 180° out of phase with the remaining weights will nullify the effect of the vibration providing a balanced rotating assembly. Controls may be provided variously positioning the eccentrics from minimum to maximum imbalance.

In the embodiment illustrated in FIG. 4, the degree of vibration may be varied by providing two or more hammer assemblies at various positions internally of the shaft and having control means to effect operation of the hammer assemblies simultaneously. The frequency of vibration may be varied by providing controls to different ones of a plurality of hammer assemblies to operate out of phase with respect to one another. In the case of electrical solenoid type of units for imparting vibration, controls may be provided in the circuitry to vary the frequency of operation of the plunger of the solenoid and also the strength of the solenoid may be varied to permit varying the degree of impact provided to the paddle assembly during rotation.

I claim:

1. A concrete slip former having a hopper with an open bottom and shaping mold extending rearwardly from said open bottom for placing a mixture of concrete in ribbon form on the ground as the slip former travels forwardly thereover and a driven rotatable paddle assembly in said hopper to force the mixture therefrom into the shaping mold, said paddle assembly comprising:

a longitudinally extending hub; means mounting said hub in said hopper for rotation about an axis transverse to the direction of travel of the slip former;

a plurality of arms secured to said hub and radiating outwardly therefrom at positions spaced longitudinally along and circumferentially around the hub;

drive means for rotating said hub; and vibrating means within said hub comprising eccentrically mounted weights rotatably mounted for vibrating at least a portion of said paddle assembly during rotation thereof.

2. A concrete slip former having a paddle assembly as defined in claim 1 wherein selected ones of said arms are of channel shape in cross-section to move the concrete from adjacent the hub toward the terminal ends of the paddle arms during rotation of the paddle assembly.

3. A concrete slip former having a paddle assembly as defined in claim 1 further including means oscillating said hub in directions along the longitudinal axis thereof during rotation of said hub.

4. A slip former having a paddle assembly as defined in claim 1 including means for variably adjusting the degree of vibration of the paddle assembly.

5. A slip former comprising a hopper mounted on ground supported means for travel over the ground surface and having an open bottom with a shaping mold extending rearwardly from said open bottom to deposit concrete mixture in the hopper on the ground and shape the deposited concrete as the slip former is propelled forwardly, a driven paddle assembly located in the hopper to agitate a mixture therein and transfer the same into the leading end of the mold and compacting the concrete in the mold as the machine moves forwardly, said paddle assembly comprising:

a longitudinally extending hub; means mounting said hub in said hopper for rotation about an axis transverse to the direction of travel of said slip former;

a plurality of arms secured to said hub and radiating outwardly therefrom at positions spaced longitudinally along and circumferentially around the hub;

drive means for rotating said hub; and vibrating means comprising eccentrically mounted weights rotatably mounted within said hub for vibrating at least a portion of said paddle assembly during rotation thereof.

6. A slip former having a paddle assembly as defined in claim 5 further including means oscillating said hub in directions along the longitudinal axis thereof during rotation of said hub.

7. A concrete slip former having a paddle assembly as defined in claim 5 wherein selected ones of said arms are of channel shape in cross-section to move the concrete from adjacent the hub toward the terminal ends of the paddle arms during rotation of the paddle assembly.

8. A slip former as defined in claim 5 wherein said hopper is supported on selected ones of the ground-supported means by power driven vertically adjusted jack means.

9. A slip former having a paddle assembly as defined in claim 5 including means for variably adjusting the degree of vibration of the paddle assembly.

* * * * *